United States Patent [19]

DeMars

[11] Patent Number: 4,857,708

[45] Date of Patent: Aug. 15, 1989

[54] TOWELETTE HEATING DEVICE

[76] Inventor: Robert A. DeMars, 7932 Maestro, Canoga Park, Calif. 91304

[21] Appl. No.: 188,711

[22] Filed: May 2, 1988

[51] Int. Cl.[4] ..... H05B 3/36

[52] U.S. Cl. ..... 219/385; 219/521; 219/439; 219/462

[58] Field of Search ..... 219/385, 386, 387, 521, 219/430, 214, 433, 435, 438, 439, 462

[56] References Cited

U.S. PATENT DOCUMENTS

| | | | |
|---|---|---|---|
| 2,638,087 | 5/1953 | Livsey | 219/386 |
| 3,051,582 | 8/1962 | Muckler | 219/386 |
| 3,108,531 | 10/1963 | Jepson | 219/387 |
| 3,410,985 | 11/1968 | Giacchero | 219/521 |
| 4,084,080 | 4/1978 | McMahan | 219/386 |
| 4,419,568 | 12/1983 | Van Overloop | 219/386 |
| 4,495,402 | 1/1985 | Burdick | 219/521 |

FOREIGN PATENT DOCUMENTS

| | | | |
|---|---|---|---|
| 2056264 | 3/1981 | United Kingdom | 219/387 |

OTHER PUBLICATIONS

Popular Science, Nov. 1957, vol. 171, No. 5, p. 143.

*Primary Examiner*—Teresa J. Walberg
*Attorney, Agent, or Firm*—Cislo & Thomas

[57] ABSTRACT

A housing for warming or heating a towelette containing a compartment, a heating element associated with the compartment, a plate for directing heat uniformly from the heating element to a towelette, insulative support for said towelette above the heat element and the plate, and a circuit for supplying power to the heating element. Power is provided by AC, with a switch for energizing the device and a thermostat for controlling the temperature. Towelettes warmed by the device are useful for refreshingly cleaning the hands, face or other parts of the body.

12 Claims, 1 Drawing Sheet

TOWELETTE HEATING DEVICE

BACKGROUND OF THE INVENTION

This invention relates to an apparatus for heating towelettes.

Moist, heated cloth towelettes are well-known, especially in Eastern cultures, for providing a refreshing way of cleaning up, such as after a meal, especially a meal with finger foods. Also, in this country, certain transportation services provide heated moist towelettes as a quick way to freshen up after a long journey.

While providing moist, heated towelettes (small towels) in commercial environments is well-known, the availability of such towelettes, which typically measure about 6 inches by 6 inches, for household applications appears to be non-existent.

OBJECTS AND SUMMARY OF THE INVENTION

Accordingly, it is an object of the present invention to provide a heating device for warming towelettes.

It is another object of the invention to provide a towelette heating device suitable for use in the home.

It is yet another object of the invention to provide a towelette heating device for heating towelettes of cloth or other materials in a controlled fashion.

These and further objects of the invention will become more apparent upon consideration of the following commentary taken in conjunction with the appended drawings.

Briefly, a towelette heating device comprises:

(a) top, bottom and side walls forming a housing;

(b) a compartment within the housing and cover means on the top of the housing to permit access to the compartment, the cover being hingedly attached at one end to the housing;

(c) a heating element cooperatively retained within the compartment;

(d) heat-insulative means for supporting at least one towelette immediately above the heating element;

(e) means for substantially uniformly directing heat from the heating element onto the towelette, the means cooperatively retained in the compartment between the heating element and the support means; and (f) circuit means adapted to supply power to the heating element and to be connected to a power source.

Thw towelette heating device of the invention controllably heats towelettes to a suitable temperature and is suitably employed in the home or office.

DETAILED DESCRIPTION OF THE PREFERRED EMBODIMENTS

Figures 1, 2, 3:
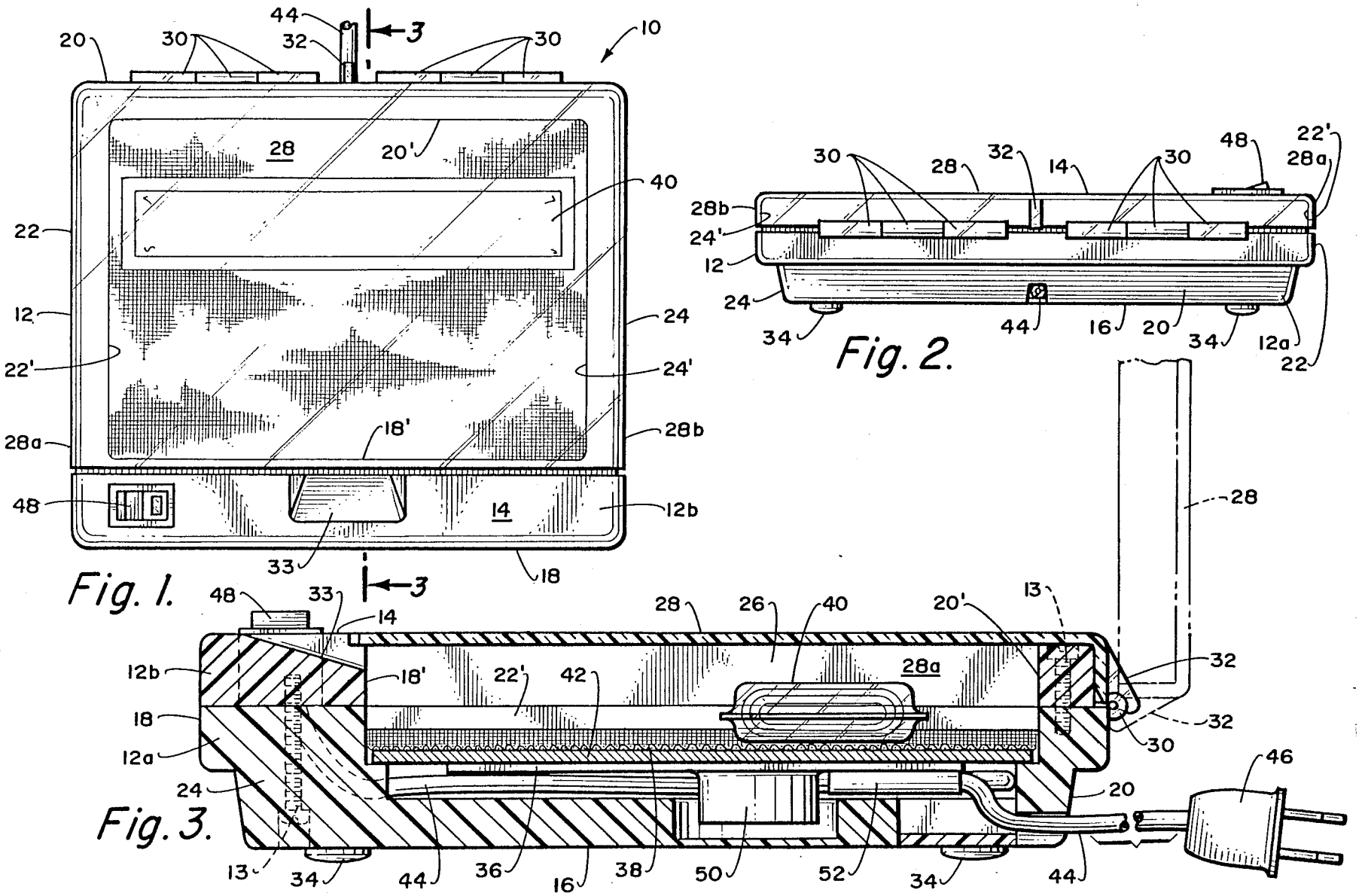
FIG. 1 is a top plan view of the towelette heating device of the invention.
FIG. 2 is a rear elevational view of the towelette heating device of the invention.
FIG. 3 is a cross-sectional view of the towelette heating device of the invention, taken along the line 3-3 of FIG. 1.

Referring now to the drawing wherein like numerals of reference designate like elements throughout, a towelette heating device of the invention is generally depicted at 10.

The towelette heating device comprises a housing 12 having a top 14, a bottom 16, front 18, rear 20 and sides 22, 24. The elements of the housing 12 define an interior compartment 26. The top 14 comprises cover means 28 to permit access to the compartment 26.

In particular, the interior compartment 26 is defined by inner walls 18', 20', 22', 24', partially in lower housing portion **12*a* and partially in upper housing portion 12*b*. The upper and lower housing portions are secured together by means such as bolts 13, blind threaded into housing 12**.

The cover means 28, which is conveniently of a material that is at least partially transparent, such as a smoked plastic, is attached to the housing 12 by hinge means 30 (advantageously, there are two such hinge means 30), which permit the cover 28 to be rotated 90 degrees about the hinge means 30 to a free-standing upright position, as depicted in phantom in FIG. 3. Downwardly depending tab 32, in the center of the hinge means 30, prevents further backward movement of the cover 28 and helps support the cover in its upright position.

Access to lift the cover means 28 is provided by a depression 33, formed in the forward portion of the upper housing **12*b*. The cover 28 extends sufficiently beyond inner wall 18' to permit the fingers to securely lift the cover 28**.

The cover 28 is provided with two downwardly depending sides **28*a* and 28*b*, which rest on indentations (not shown) provided in lower housing portion 12*a*. The cover 28 makes sufficient mating contact with the housing 12** to prevent excessive escape of heat.

Feet 34 (there are four such, one in each corner of bottom 16), comprise a non-marring material and provide support of the housing 12 on a surface (not shown).

A heating element 36 is supported within the compartment 26. The heating element preferably comprises a conventonal rubber heating pad, which comprises heater wires embedded in a silicone rubber matrix. Such a product is commercially available.

Support means 38, lying at least over the heating element 36, provides support for at least one towelette 40, which is to be heated or warmed in accordance with the teachings of this invention. Such towelettes are typically of terry cloth material and are 6 inches square (unfolded), although other absorbent materials and sizes may be employed. The support means 38 comprises a porous material that is a poor conductor of heat. A preferred example of such a heat-insulative material is a fiber glass mesh screen.

Heat directing means 42 substantially uniformly direct heat from the heating element 36 onto the towelettes 40. The heating directing means, which preferably comprises a metal plate, such as aluminum, is positioned in the compartment 26 between the heating element 36 and the support means 38. Thus, it will be appreciated that the support means 38 serves to prevent direct contact of the towelette 40 with the source of heat 42, and thereby reduce the possibility of over-heating of the towelette 40.

Power is supplied to the heating element 36 by means of AC power, provided through cord 44, which runs between wall plug 46 and the heating element 36. In particular, a switch means 48, conveniently a rocker switch, is used to turn the power on and off. The heating element 36 is preferably controlled by a thermostat 50, which prevents over-heating of the towelettes. Most preferably, a thermostat set to operate between about 110° F. and 180° F. is employed, specifically between about 140° F. and 160° F. A bracket 52 is used to hold AC cord 44 and to optionally permit retraction thereof into the casing 12 when not in use.

Operation of the device of the invention is as follows. The cover 28 is lifted up to its upright position. At least one towelette 40, moistened if desired, is placed in the compartment 26, on support means 38. The wall plug 46 is plugged into a suitable receptacle (if not already in place), and the switch means 48 is turned on. The cover 28, if not already lowered upon placement of the towelettes 40 into the compartment 26, is lowered.

After heating for a period of time (typically within minutes), the towelette 40 is removed from the device 10 and used for its intended purpose.

Thus, a towelette heating device for warming towelettes and the like has been disclosed. Many changes and modifications will readily occur to those of skill in the art, and all such changes and modifications will readily occur to those of skill in the art, and all such changes and modifications are intended to fall within the scope of the invention, as defined by the appended claims. Examples of such modifications include providing a timer to turn the device on and/or off at preselected times.

What is claimed is:

1. A towelette heating device for heating towelettes comprising:

(a) a top having a forward section including an indentation thereupon, a bottom and low lying side walls forming a housing;

(b) a compartment within said housing and a partially or totally transparent cover means on said top of said housing to permit access to said compartment and view the towelettes therethrough, said cover hingedly attached at one end to said housing and proximate said indentation of said forward section at an opposite end of said housing to permit access to lift said cover;

(c) a heating element cooperatively retained within said compartment;

(d) heat-insulative means for supporting at least one towelette immediately above said heating element;

(e) means for substantially uniformly directing heat from said heating elements onto said at least one towelette, said means cooperatively retained in said compartment between said heating element and said support means; and (f) circuit means adapted to supply power to said heating element and to be connected to a power source.

2. The device in accordance with claim 1 wherein said heating element comprises heater wires embedded in a silicone rubber matrix.

3. The device in accordance with claim 1 wherein said heat-insulative support means comprises a non-heat conductive mesh.

4. The device in accordance with claim 3 wherein said heat-insulative support means comprises a fiber glass screen.

5. The device in accordance with claim 1 wherein said heat directing means comprises a metal plate.

6. The device in accordance with claim 5 wherein said circuit means further includes a thermostat means.

7. The device in accordance with claim 6 wherein said thermostat means permits heating towelettes to between about 110° and 180° F.

8. The device in accordance with claim 7 wherein said thermostat means permits heating towelettes to between about 140° and 160° F.

9. A towelette heating device comprising:

(a) top, bottom and sides walls forming a housing;

(b) a compartment within said housing and cover means on said top of said housing to permit access to said compartment, said cover means hingedly attached at one end to said housing, with said housing provided with a depression at the opposite end thereof to permit access to lift said cover;

(c) a downwardly depending tab at said one end to prevent the cover from opening beyond 90°;

(d) a rubber heating pad cooperatively retained within said compartment, said pad comprising wires embedded in a silicone rubber matrix;

(e) heat-insulative means for supporting at least one towelette immediately above said heating element, said means comprising a fiber glass mesh screen;

(f) means for substantially uniformly directing heat from said heating pad onto said at least one towelette, said means comprising a metal plate cooperatively retained in said compartment between said heating element and said support means; and (g) circuit means adapted to supply power to said heating pad and to be connected to a power source.

10. The device in accordance with claim 8 wherein said circuit means further includes a thermostat means.

11. The device of claim 11 wherein said thermostat means permits heating towelettes to between about 110° and 180° F.

12. The device of claim 11 wherein said thermostat means permits heating towelettes to between about 140° and 160° F.

* * * * *